US006950618B2

(12) United States Patent
Shimizu et al.

(10) Patent No.: US 6,950,618 B2
(45) Date of Patent: Sep. 27, 2005

(54) IMAGE FORMING APPARATUS HAVING A REMOVABLE FIXING DEVICE

(75) Inventors: Tadafumi Shimizu, Ogori (JP); Shouichi Kitagawa, Fukuoka (JP); Masahiro Samei, Fukuoka (JP); Kazunori Matsuo, Onojo (JP); Keiichi Matsuzaki, Kurume (JP); Kenji Asakura, Kyoto (JP); Hideki Tatematsu, Ashiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 46 days.

(21) Appl. No.: 10/659,910

(22) Filed: Sep. 11, 2003

(65) Prior Publication Data

US 2004/0052548 A1 Mar. 18, 2004

(30) Foreign Application Priority Data

Sep. 12, 2002 (JP) ..... P.2002-266723
Jun. 26, 2003 (JP) ..... P.2003-182323

(51) Int. Cl.[7] ..... G03G 15/16

(52) U.S. Cl. ..... 399/122; 399/320; 399/12; 399/23; 399/107; 399/110; 399/122; 399/111; 219/216

(58) Field of Search ..... 399/12, 23, 107, 399/110, 122, 320, 111; 219/216

(56) References Cited

U.S. PATENT DOCUMENTS 5,732,309 A 3/1998 Okuno et al.
6,483,995 B2 * 11/2002 Iwaki et al. ..... 399/12

FOREIGN PATENT DOCUMENTS

JP 9-297489 11/1997
JP 2001-249562 9/2001
JP 2001-343846 12/2001

* cited by examiner

*Primary Examiner*—Hoan Tran
(74) *Attorney, Agent, or Firm*—Pearne & Gordon LLP

(57) ABSTRACT

In a fixing unit 230, a medium introducing port 250 is provided near a gripping part 230*a* of a housing 230, and a sheet material 90 to be subjected to a fixing process is guided to the medium introducing port. A shutter 260 is provided slanted at a given angle with respect to a gripping surface 240 of the gripping part 230*a* of the fixing unit 230 such that the shutter has a fulcrum at a part thereof, which is closer to the gripping part 230*a* of the fixing unit 230, at the medium introducing port 250, and the shutter 260 is turnable to a position to close the medium introducing port 250 while resisting the urging forces of the twisted springs 270.

23 Claims, 10 Drawing Sheets

IMAGE FORMING APPARATUS HAVING A REMOVABLE FIXING DEVICE

BACKGROUND OF THE INVENTION

The present invention relates to a fixing device in use for an image forming apparatus of the electrostatic recording type, such as a copying machine, a facsimile or a printer.

A conventional image forming apparatus based on an electrophotographic system operates in the following way. A photosensitive member as an image carrying body is charged by a charger. The charged photosensitive member is irradiated with light containing image information to thereby form a latent image on the photosensitive member. The latent image is developed, with a developing device, into a toner image. The toner image is transferred onto a recording medium to form or reproduce a picture on the medium.

With colorization of the image, there is proposed a color image forming apparatus of the tandem type for forming a full color image. This type of the image forming apparatus is provided with a plurality of image forming units each executing the image forming process as mentioned above. Color toner images of cyan, magenta, and yellow, and preferably black are formed on photosensitive members provided for those colors. At transfer positions on the photosensitive members, those toner images are superimposed one on another, and transferred onto an endless intermediate transfer body.

The image forming apparatus of the toner image transfer type includes a fixing device. The fixing device contains a fixing nip part formed with a couple of rollers. The fixing nip part nips and transfers the recording medium. When the recording medium passes through the nip part, the toner image, not yet fixed, on the recording medium is fused under pressure, and is fixed on the recording medium. Since the fixing unit heats the toner for its fusing, temperature of the rollers is high.

For example, it has proposed in JP-A-2001-249562.

When the fixing device is detached from the image forming apparatus immediately after the printing operation ends, a message to inhibit the worker from touching the hot rollers is visually presented for the purpose of jamming removal or part replacement.

However, it is inevitable that the worker will touch the hot rollers carelessly or accidentally. Accordingly, use of only the message is not sufficient for giving a sure warning to the worker.

SUMMARY OF THE INVENTION

It is, therefore, an object of the invention to provide a fixing unit having a function to prevent the worker from touching the hot rollers in maintenance work and an image forming apparatus provided with the fixing device.

To achieve the above object, there is provided a fixing device which nips and transports a recording medium by a fixing nip part defined by a couple of rollers installed in a housing, and fuses and fixes an unfixed toner on a recording medium. The fixing device is comprised of: a gripping part which is formed on the housing and maybe gripped when the fixing device is handled; a medium introducing port which is formed near the gripping part of the housing, and to which a recording medium to be subjected to a fixing process is guided; and a shutter which is provided slanted at a given angle with respect to a gripping surface of the gripping part such that the shutter has a fulcrum at a part thereof closer to the gripping part at the medium introducing port, and is turnable to a position to close the medium introducing port while resisting the urging forces of urging means.

With such a mechanical arrangement, when the user grips the fixing unit with his fingers to handle the fixing unit, the finger causes the shutter to turn to a position to close the medium introducing port. Accordingly, the finger cannot enter the inside of the fixing unit and, hence, in handling the fixing unit, the user never touches the hot roller or rollers.

DETAILED DESCRIPTION OF THE PREFERRED EMBODIMENTS

Figure 1:
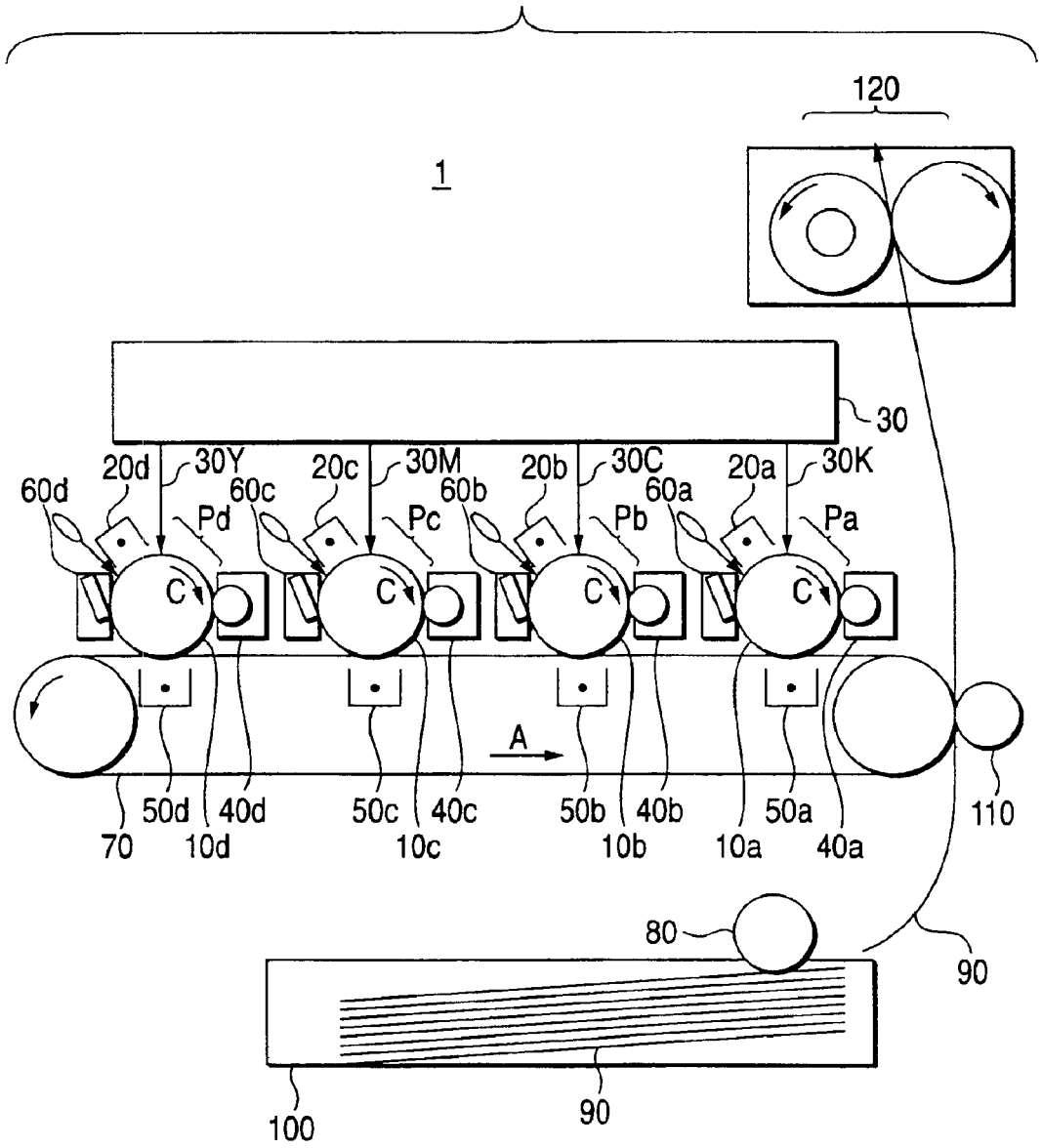
FIG. 1 is a diagram schematically showing an arrangement of an image forming apparatus equipped with a fixing unit which is constructed according to the present invention.

In a broad sense, a fixing device which nips and transports a recording medium by a fixing nip part defined by a couple of rollers installed in a housing, and fuses and fixes an unfixed toner on a recording medium, is comprised of: a gripping part which is formed on the housing and may be gripped when the fixing device is handled; a medium introducing port which is formed near the gripping part of the housing, and to which a recording medium to be subjected to a fixing process is guided; and a shutter which is provided slanted at a given angle with respect to a gripping surface of the gripping part such that the shutter has a fulcrum at a part thereof closer to the gripping part at the medium introducing port, and is turnable to a position to close the medium introducing port while resisting the urging forces of urging means. With such a mechanical arrangement, when the user grips the fixing unit with his fingers to handle the fixing unit, the finger causes the shutter to turn to a position to close the medium introducing port. Accordingly, the finger cannot enter the inside of the fixing unit and, hence, in handling the fixing unit, the user never touches the hot roller or rollers.

Preferred embodiments of the invention will be described with reference to FIGS. 1 through 11. In those figures, like or equivalent portions will be designated by like reference numerals, and duplicated description is omitted.

An outline of an image forming apparatus 1 constructed according to the present invention will first be described. In the description to follow, the image forming apparatus 1 is an image forming apparatus employing the electrophotographic system, in particular, a tandem type of image forming apparatus which includes developing devices provided respectively for four basic color toners contributing to the color development of the color image, and in which four color images are superimposed one on another on a transfer body and collectively transferred onto the transfer body. It is evident that the present invention may be applied not only to the tandem type of image forming apparatus, but also to every type of image forming apparatus irrespective of the number of developing devices, and presence of intermediate transfer body.

As seen from FIG. 1, charging devices 20*a*, 20*b*, 20*c* and 20*d*, an exposure unit 30, developing devices 40*a*, 40*b*, 40*c* and 40*d*, transfer devices 50*a*, 50*b*, 50*c* and 50*d*, and cleaning devices 60*a*, 60*b*, 60*c* and 60*d* are disposed around photosensitive member drums 10*a*, 10*b*, 10*c* and 10*d*, respectively. The charging devices 20*a*, 20*b*, 20*c* and 20*d* uniformly charge the surfaces of the photosensitive member drums 10*a*, 10*b*, 10*c* and 10*d*, respectively. The exposure unit 30 irradiate the surfaces of the charged photosensitive member drums 10*a*, 10*b*, 10*c* and 10*d* respectively with scanning lines 30K, 30C, 30M and 30Y of laser beams corresponding to image data of specific colors, whereby electrostatic latent images are formed on the surfaces of the photosensitive member drums. The developing devices 40*a*, 40*b*, 40*c* and 40*d* develop the electrostatic latent images formed on the photosensitive member drums 10*a*, 10*b*, 10*c* and 10*d* into toner images. The transfer devices 50*a*, 50*b*, 50*c* and 50*d* transfer the toner images that were developed on the photosensitive member drums 10*a*, 10*b*, 10*c* and 10*d*, onto an endless, intermediate transfer belt (intermediate transfer body) 70. The cleaning devices 60*a*, 60*b*, 60*c* and 60*d* remove toner left on the photosensitive member drums 10*a*, 10*b*, 10*c* and 10*d* after the toner images are transferred from the photosensitive member drums 10*a*, 10*b*, 10*c* and 10*d* onto the intermediate transfer belt 70.

The exposure unit 30 is disposed while being slanted with respect to the photosensitive member drums 10*a*, 10*b*, 10*c* and 10*d* at a predetermined angle. The intermediate transfer belt 70 is rotated in a direction of an arrow A in the illustrated case. The image forming stations Pa, Pb, Pc and Pd form color images of black, cyan, magenta and yellow, respectively. The monocolor images of the respective colors having been formed on the photosensitive member drums 10*a*, 10*b*, 10*c* and 10*d* are superimposed one on another on the intermediate transfer belt 70 to thereby form a full color image.

A sheet feed cassette 100 containing sheet materials (recording media) 90, such as printing sheets, is provided in a lower part of the image forming apparatus. The sheet materials 90 are transferred, sheet by sheet, from the sheet feed cassette 100 into a sheet transport path (recording medium transporting path) by a sheet feed roller 80.

A sheet-material transport roller 110 and a fixing device 120 are disposed along the sheet transport path. The sheet-material transport roller 110 contacts with the outer peripheral surface of the intermediate transfer belt 70 over a predetermined range of the surface, and transfers the color image that was formed on the intermediate transfer belt 70 onto the sheet material 90. The fixing device 120 fixes the color image, which has been transferred to the sheet material 90, onto the sheet material 90 under pressure and heat, which are caused by the nipping and rotation of the roller.

The thus constructed image forming apparatus 1 first forms a latent image of a black component of the image information on the photosensitive member drum 10*a*, by cooperation of the charging device 20*a* in the image forming station Pa and the exposure unit 30. The latent image thus formed is visualized into a black toner image by use of the developing device 40*a* containing black toner, and is transferred onto the intermediate transfer belt 70 by use of the transfer device 50*a*.

While the black toner image is transferred onto the intermediate transfer belt 70, a latent image of the cyan component is formed in the image forming station Pb, and subsequently a cyan toner image of the cyan toner is visualized by use of the developing device 40*b*. Then, the transfer device 50*a* of the image forming station Pb transfers the cyan toner image, in a superimposing manner, onto the black toner image on the intermediate transfer belt 70, which has undergone the transfer of the black toner image in the preceding image forming station Pa.

Subsequently, a magenta toner image and a yellow toner image will be formed in similar manners. When the superimposing operation of the four color toner images on the intermediate transfer belt 70 is completed, the four color toner images are collectively transferred, by the sheet-material transport roller 110, onto the sheet material 90 which has been fed from the sheet feed cassette 100 by the sheet feed roller 80. And, the toner image thus transferred is fused and fixed on the sheet material 90 by the fixing device 120, whereby a full color image is formed on the sheet material 90.

Next, the fixing device used in the image forming apparatus 1 will be described.

Figure 2:
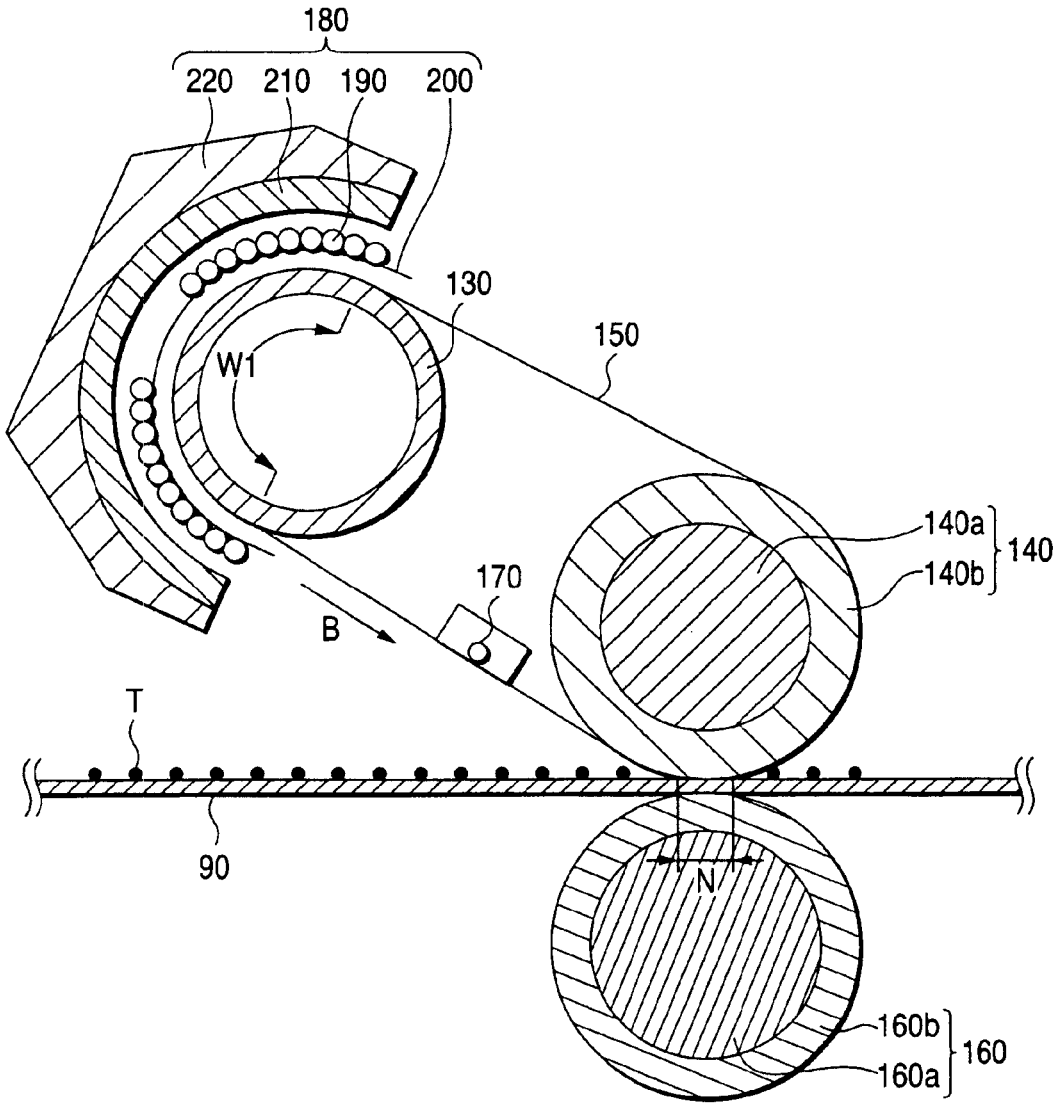
FIG. 2 is a cross sectional view showing an inner construction of the fixing unit which is an embodiment of the invention.

As shown in FIG. 2, the fixing device is made up of a heating roller 130, a fixing roller (roller) 140, an endless heat-resistance belt 150, and a pressure roller (roller) 160. The heating roller 130 is heated by electromagnetic induction by an induction heating unit 180. The fixing roller 140 is disposed parallel to the heating roller 130. The heat resistance belt 150 is stretched between the heating roller 130 and the fixing roller 140, heated by the heating roller 130, and rotated in a direction of an arrow B with the rotation of either of those rollers. The pressure roller 160 is pressed against the fixing roller 140 with the heat-resistance belt 150 being interposed therebetween, and is rotated in the forward direction with respect to the heat-resistance belt 150.

The heating roller 130 consists of a hollowed, cylindrical rotary body formed with a magnetic metallic member, such as iron, cobalt, nickel or an alloy of those metallic materials. The heating roller is 20 mm in outside diameter, 03 mm in thickness, low in thermal capacity, and high in temperature rising rate. To impart the releasability to the heating roller, a release layer (not shown), which is made of fluororesin and has a thickness of 20 $\mu$m, is formed over the surface of the heating roller.

The fixing roller 140 includes a metallic core bar 140*a* made of stainless steel, for example, and an elastic member 140*b* which is formed with solid or foamed heat-resistance silicone rubber and covers the core bar 140*a*. To form a fixing nip part N of a predetermined width between the pressure roller 160 and the fixing roller 140 by use of a pressing force applied from the pressure roller 160, an outside diameter of the fixing roller is about 30 mm, larger than that of the heating roller 130.

The heat-resistance belt 150 stretched between the heating roller 130 and the fixing roller 140 is heated at a contact part W1 between the heat-resistance belt and the heating roller 130 heated by the induction heating unit 180. The inner surface of the heat-resistance belt 150 is continuously heated when the heating roller 130 and the fixing roller 140 are rotated, so that the belt is entirely heated.

The pressure roller 160 includes a core bar 160*a* as a metallic cylindrical member which has good thermal conductivity and is made of copper or aluminum, and an elastic member 160*b* which is formed on the surface of the photosensitive member drum 10*a*, and has good heat resistance and good toner releasability. SUS other than the metallic material may be used for the core bar 160*a*.

The induction heating unit 180 for heating the heating roller 130 by electromagnetic induction, as shown in FIG. 2, is disposed facing the outer peripheral surface of the heating roller 130. The induction heating unit includes an exciting coil 190 as a magnetic field generating means, and a coil guide plate 200 wound with the exciting coil 190.

Temperature of a belt inner surface of the heat-resistance belt 150, which is heated by the induction heating unit 180, is detected by a temperature detecting device 170. The temperature detecting device contains a thermosensitive element having a high thermal response, such as a thermistor, and is disposed in contact with the inner surface of the heat-resistance belt 150 at a position near the entrance of the fixing nip part N. Temperature of the heat-resistance belt 150 is stably kept at, for example, 180° C. by using the detected temperature.

Figure 3:
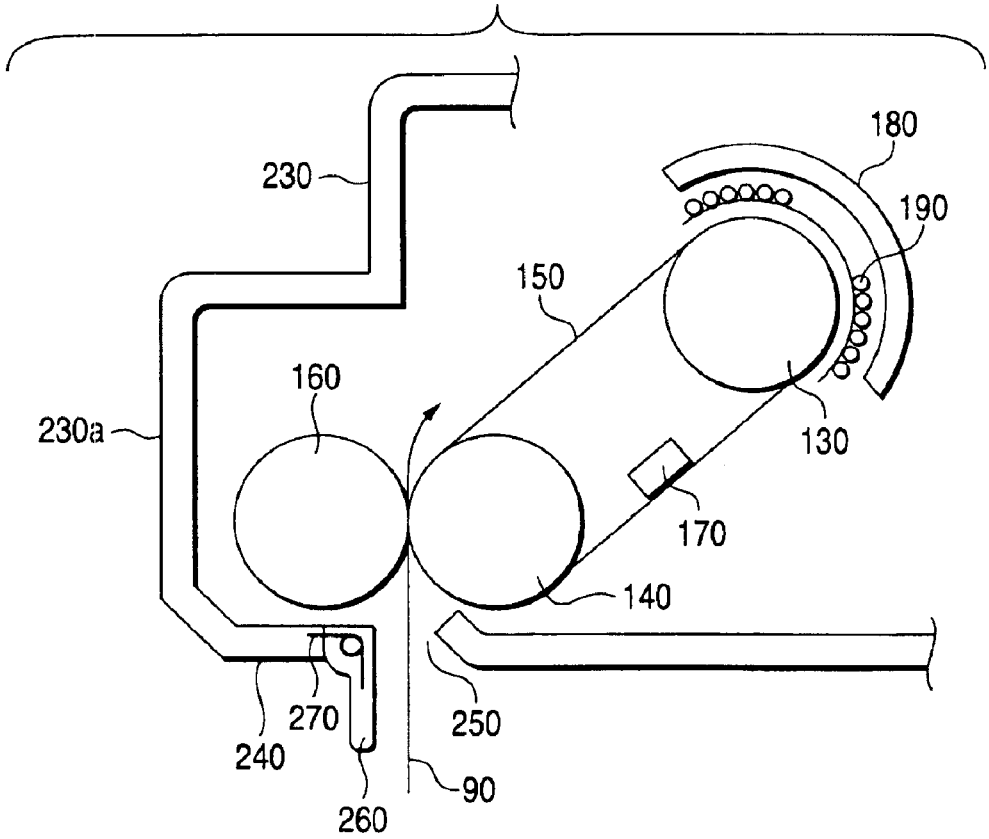
FIG. 3 is a cross sectional view showing a key portion of the fixing unit of the embodiment of the invention.
Figure 4:
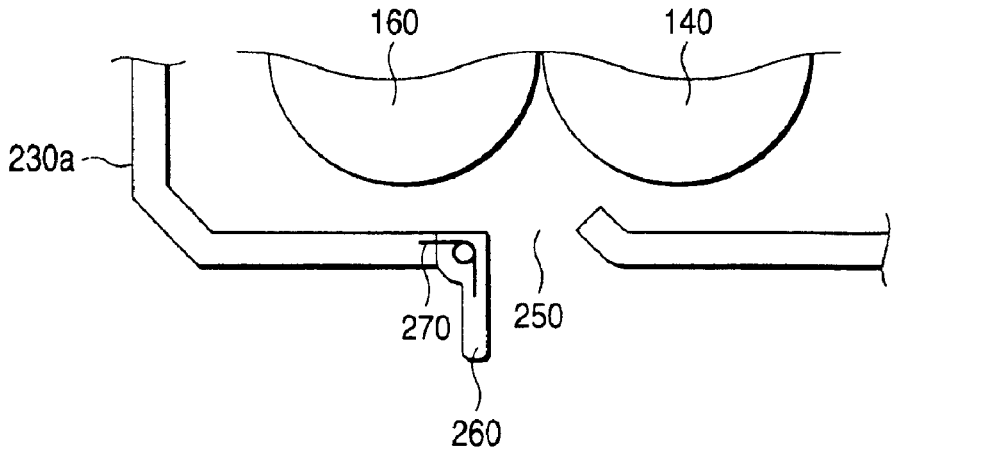
FIG. 4 is a cross sectional view showing a key portion of the fixing unit of FIG. 3 in a state that it is attached to the image forming apparatus.
Figure 5:
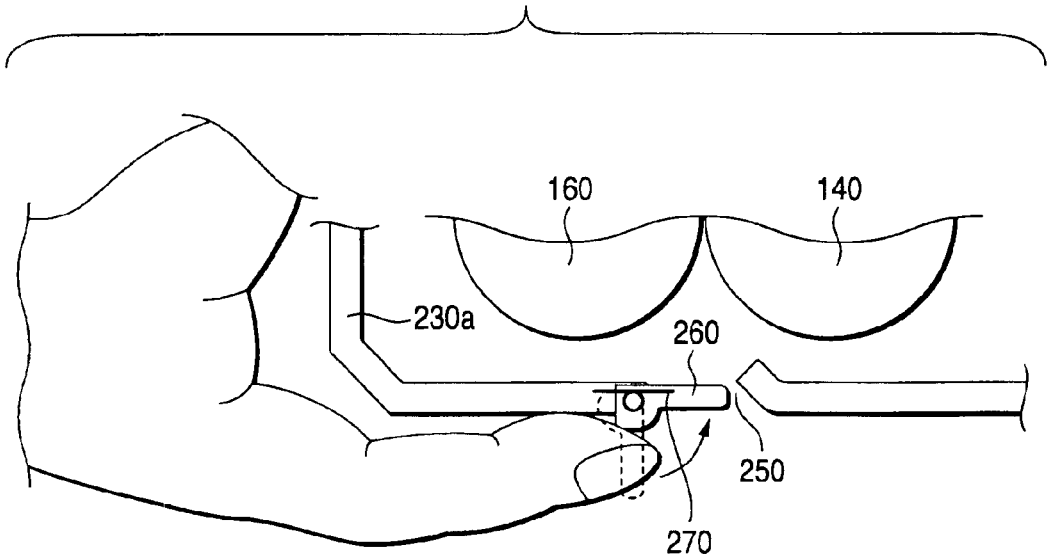
FIG. 5 is a cross sectional view showing a key portion of the fixing unit of FIG. 3 when the fixing unit is handled.
Figure 6:
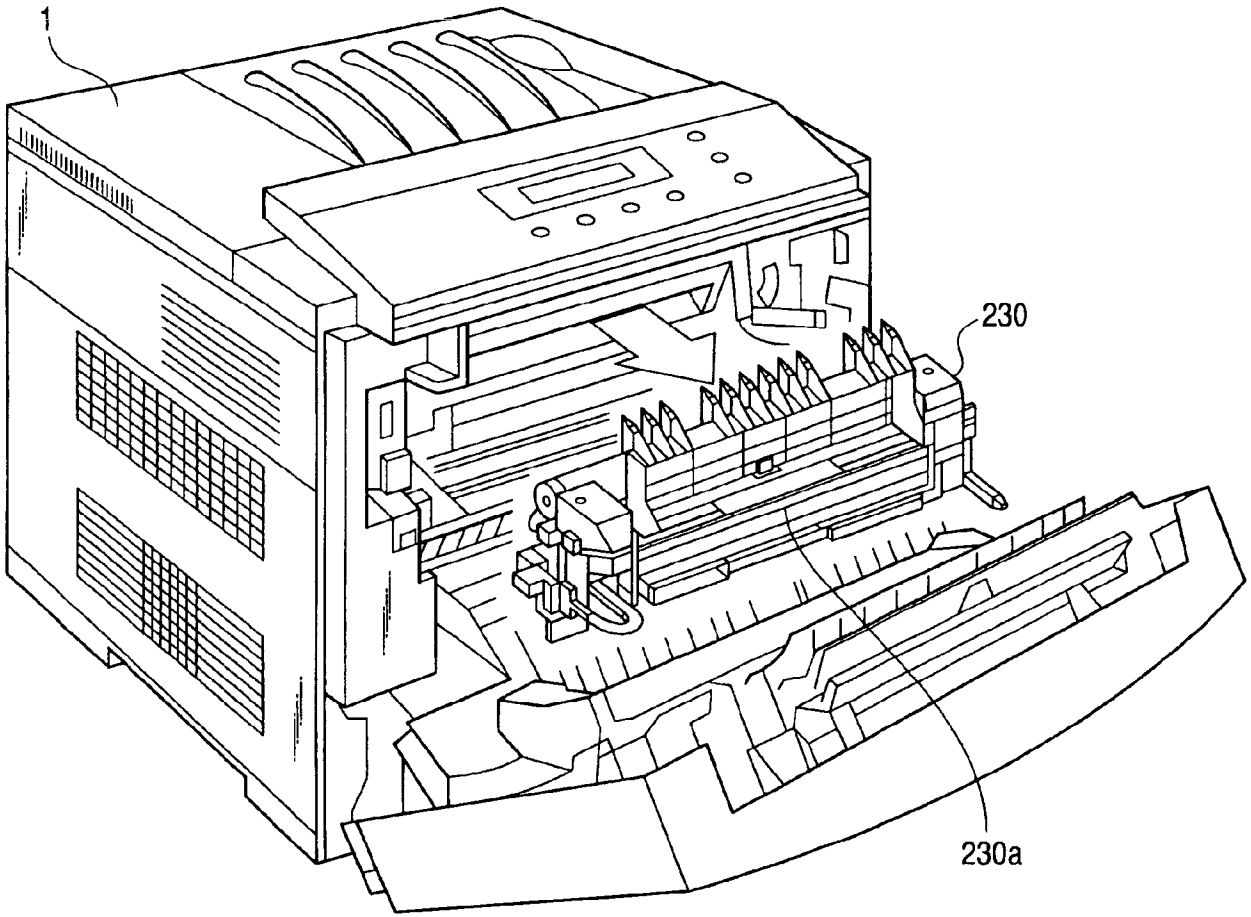
FIG. 6 is an overall perspective view showing how the fixing unit, which is the embodiment of the invention, is attached to and detached from the image forming apparatus.
Figure 7:
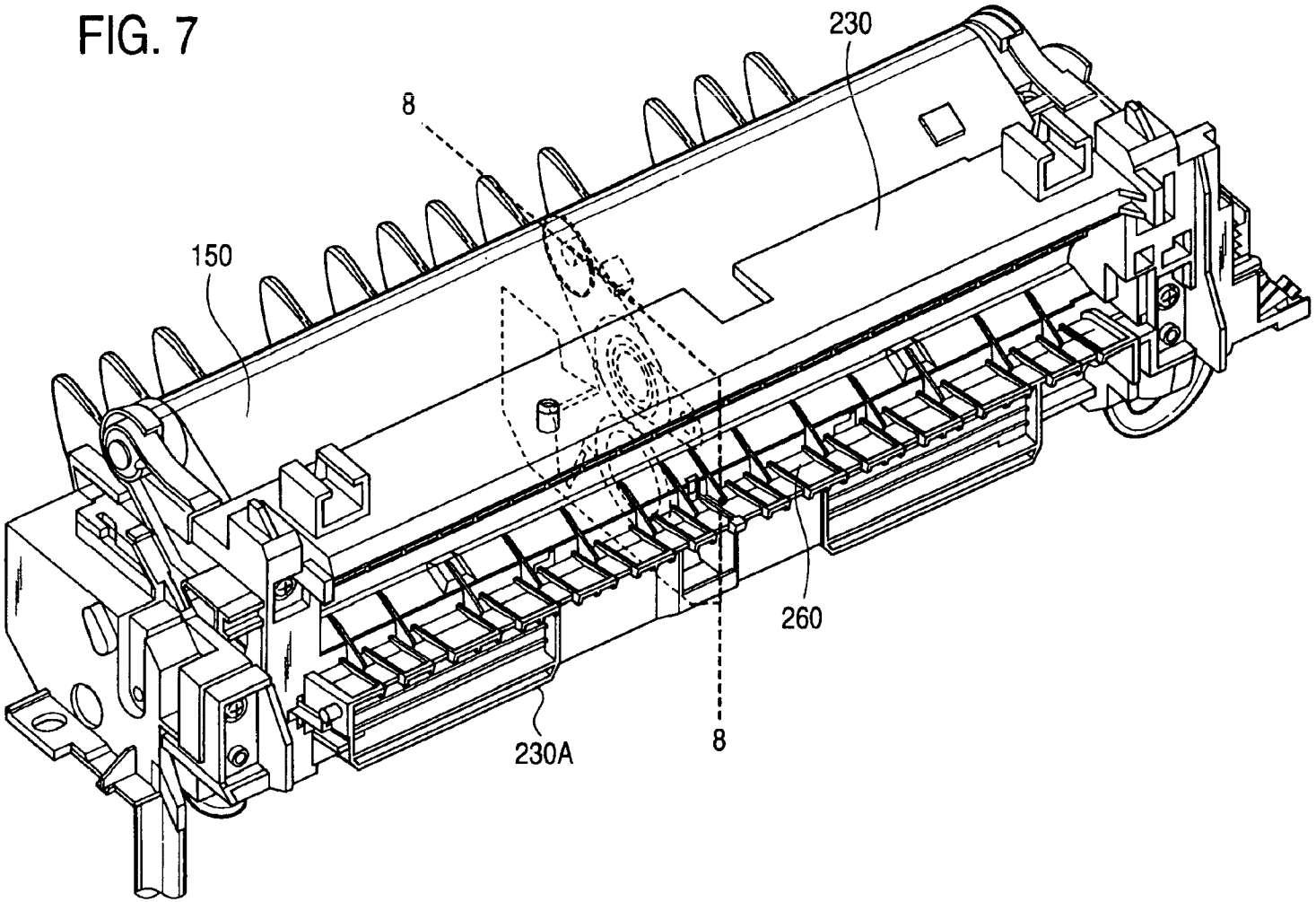
FIG. 7 is a perspective view showing the overall fixing unit which is the embodiment of the invention.
Figure 8:
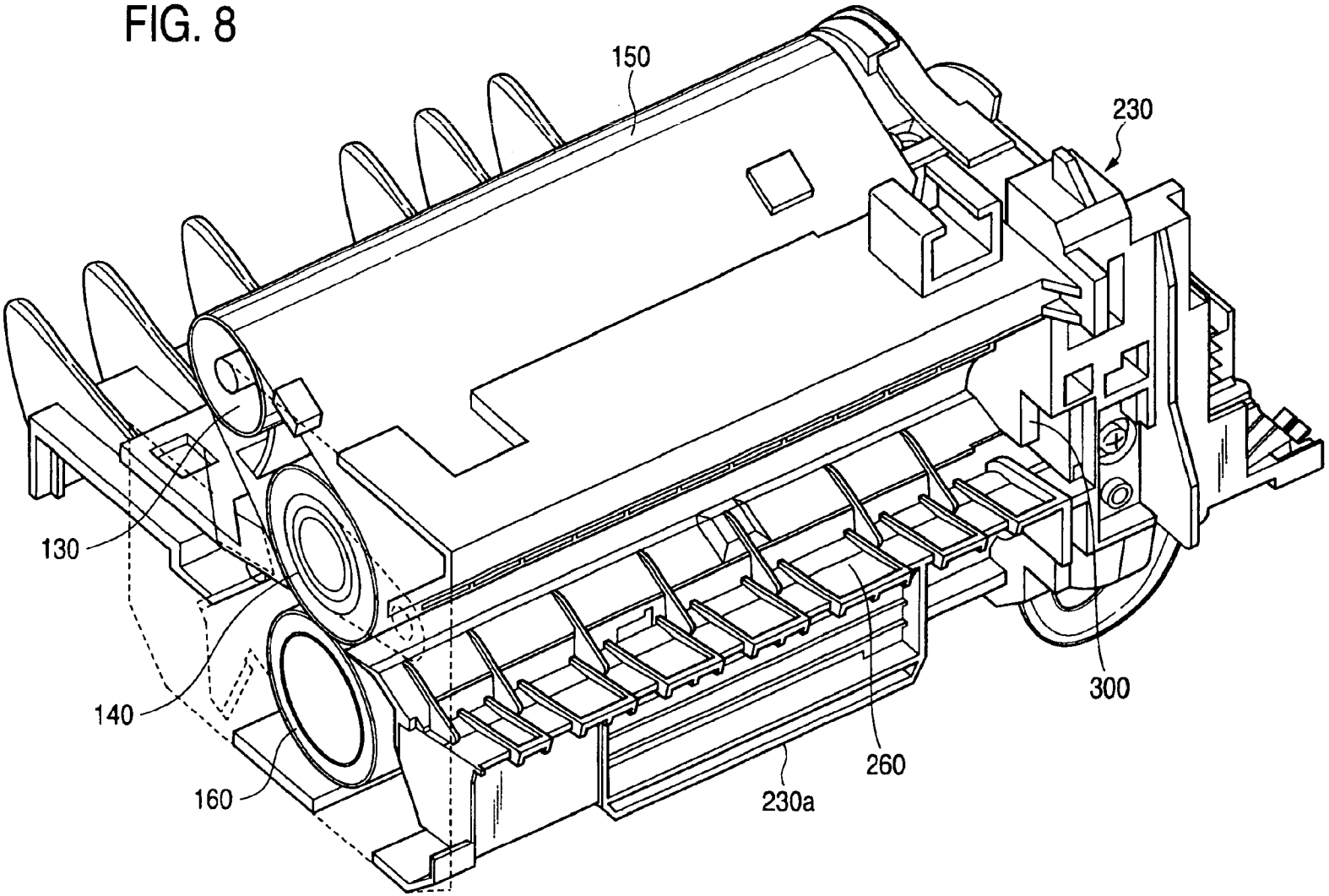
FIG. 8 is a cross sectional view taken on line 8—8 in FIG. 7.

As shown in FIG. 3, a gripping part 230*a* is formed as a part of the housing. The user grips the gripping part 230*a* when he detaches the fixing unit 230 from the image forming apparatus 1 and attaches it to the latter. The fixing unit 230 includes a couple of the fixing roller 140 and the pressure roller 160 which are for nipping and transporting the sheet material 90, the heat-resistance belt 150 and the heating roller 130. A medium introducing port 250 to which the sheet material 90 to be subjected to the fixing process is guided, is formed near the gripping part 230*a* of the fixing unit 230.

Figure 9:
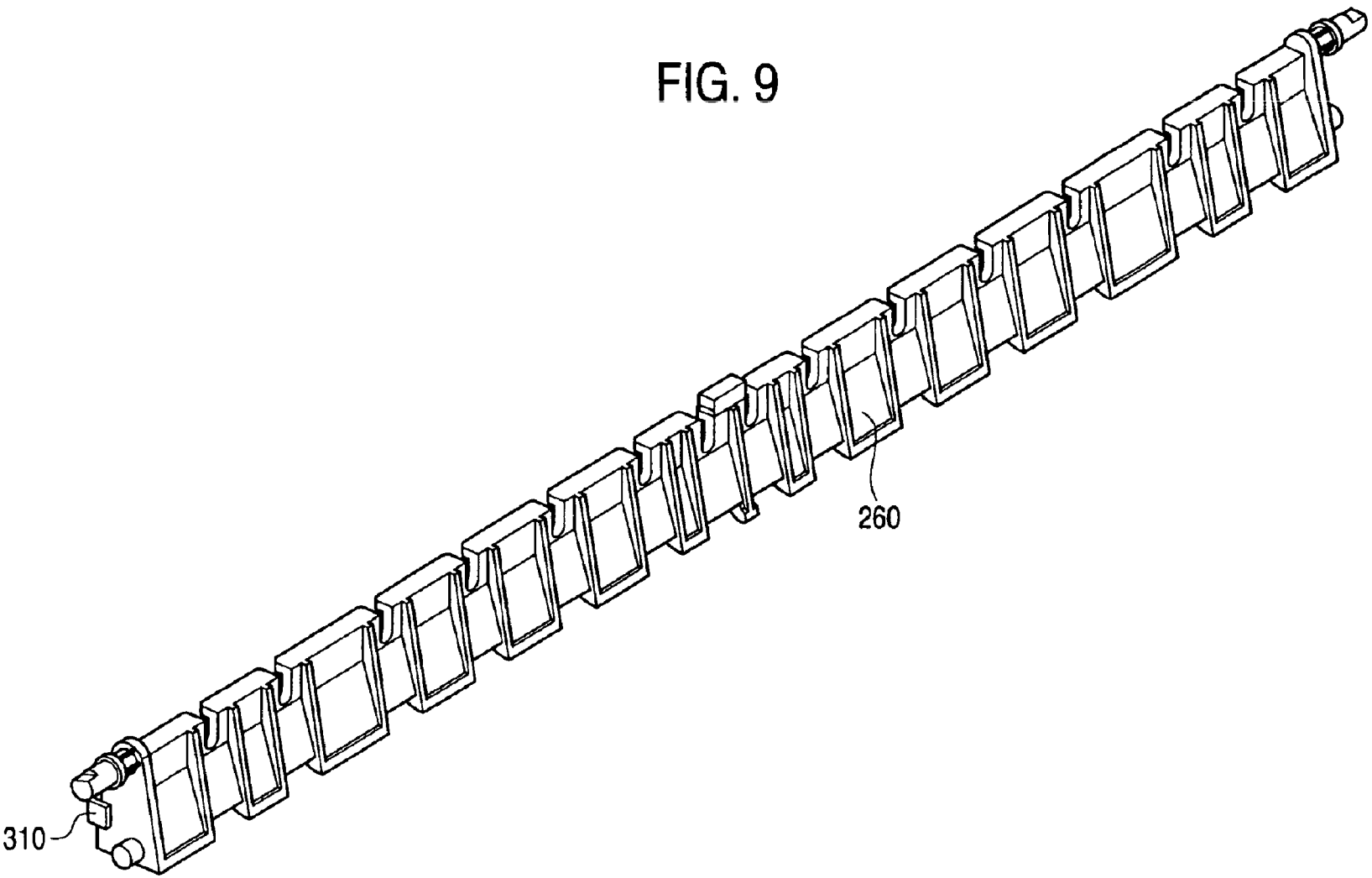
FIG. 9 is a perspective view showing a shutter in the fixing unit shown in FIG. 7.
Figure 10:
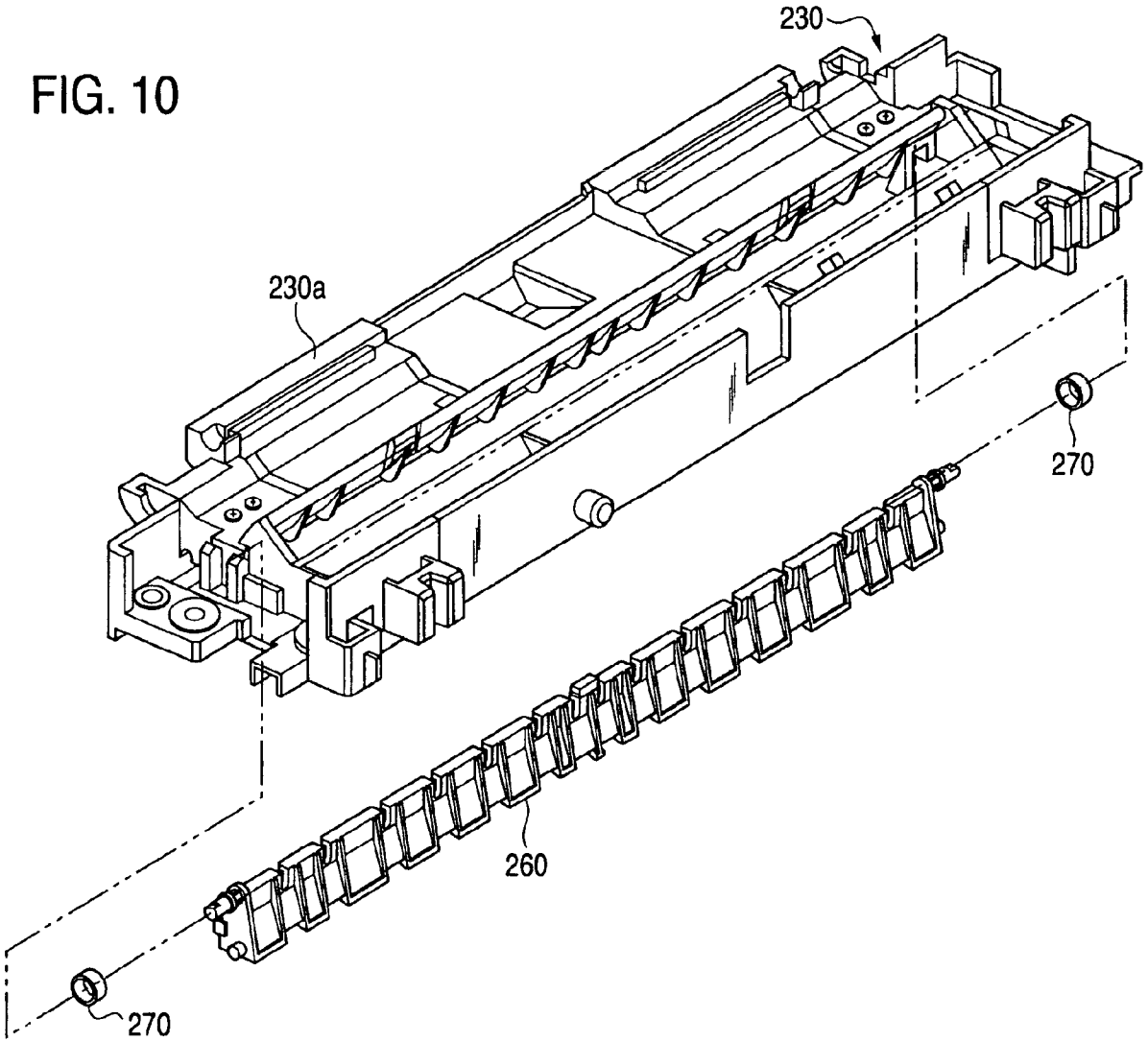
FIG. 10 is a perspective view showing how to attach the shutter in the fixing unit shown in FIG. 7.
Figure 11:
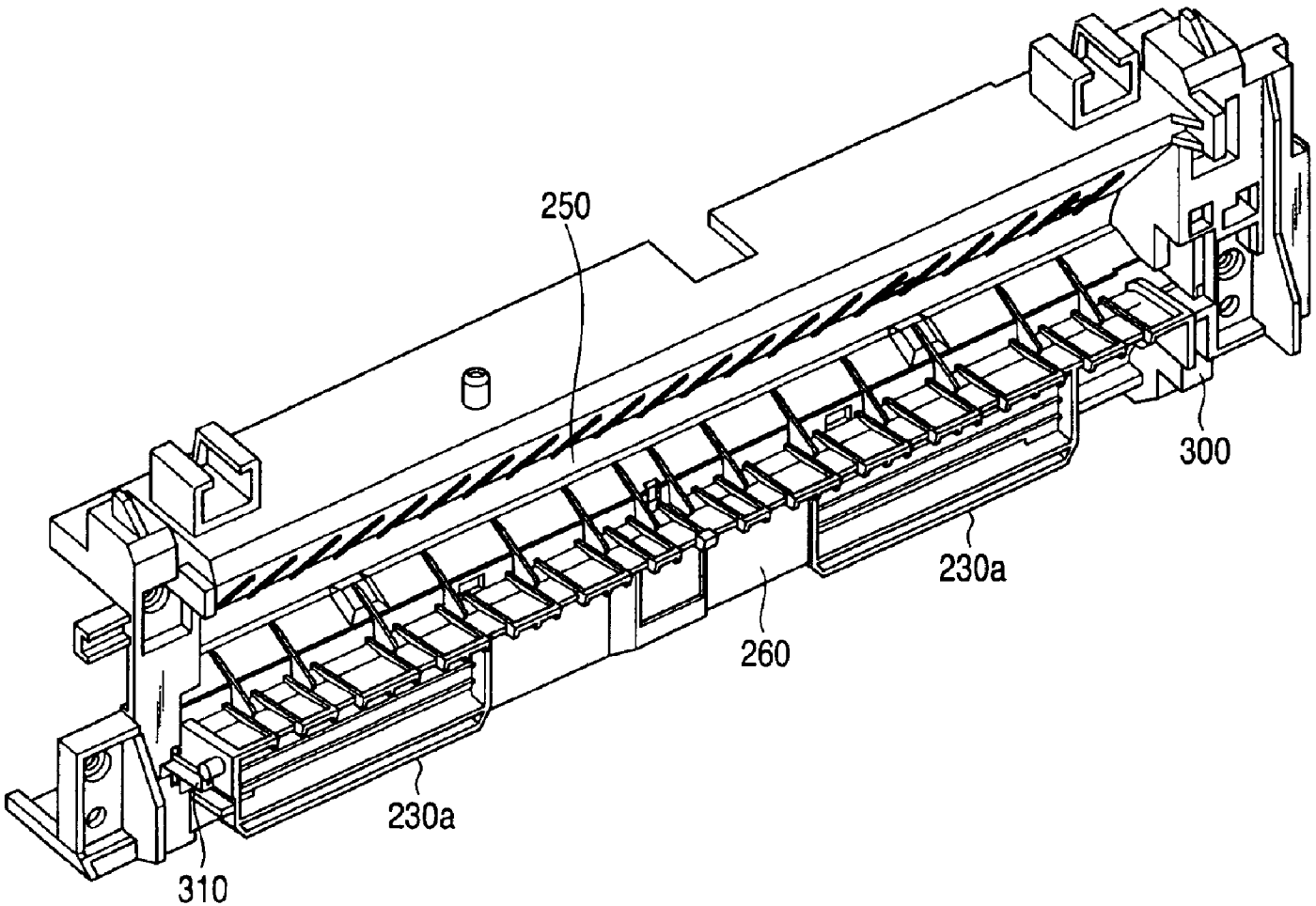
FIG. 11 is a partly, perspective view showing the fixing unit which is attached with the shutter in FIG. 10

A shutter 260 is provided at the medium introducing port 250. The shutter 260 is provided slanted at a given angle with respect to gripping surface 240 of the gripping part 230*a* such that the shutter has a fulcrum at a part of the shutter which is closer to the gripping part 230*a*. A couple of twisted springs 270 are provided on both ends of the shutter 260 and urge the shutter 260 in such a direction as to open the medium introducing port 250. The shutter 260 is turnable to a position where it closes the medium introducing port 250, while resisting the urging forces of the twisted springs 270. As shown in FIGS. 9 and 11, hook parts 310 to which the twisted springs 270 are fixed are provided on both ends of the shutter.

In a state that the fixing unit 230 is attached to the image forming apparatus 1, as shown in FIGS. 4, 7, 8 and 11, the urging forces of the twisted springs 270 place the shutter 260 at such a position as to allow the medium introducing port 250 to open. In this state, the shutter 260 functions as a guide for guiding the sheet material 90 to the medium introducing port 250.

When, to attach or detach the fixing unit 230 to or from the image forming apparatus 1, the user grips the gripping part 230*a* with his fingers, and his finger approaches the medium introducing port 250, the finger pushes and turns the shutter 260 down to a position to close the medium introducing port 250, so that the finger cannot enter the fixing unit through the medium introducing port 250. With such a structure, even if the user carelessly handles the fixing device, the user never touches the hot rollers 140 and 160. In the fixing unit 230, stoppers 300 are provided at parts which face both ends of the shutter 260. In a state that the shutter 260 closes the medium introducing port 250, both ends of the shutter 260 come in contact with the stoppers 300, so that the shutter 260 is prevented from turning beyond the medium introducing port and entering the fixing unit 230. With such a structure, when the user closes the shutter 260 while resisting the urging forces of the twisted springs 270, the shutter 260 surely closes the medium introducing port 250.

Here, the wording "to close the medium introducing port 250" involves a state that the medium introducing port 250 is not completely closed and also such an opening of the medium introducing port 250 as to prevent the finger gripping the housing 230 from entering the inside of the fixing unit.

While the induction-basis fixing device using the induction heating unit 180 as the heat source is discussed in the embodiment mentioned above, it will readily be understood that another heat source, such as a halogen lamp, may be used for the heat source of the fixing device.

As seen from the foregoing description, when the user grips the fixing unit with his fingers to handle the fixing unit, the finger causes the shutter to turn to a position to close the medium introducing port. Accordingly, the finger cannot enter the inside of the fixing unit and, hence, in handling the fixing unit, the user never touches the hot roller or rollers.

Further, the shutter serves also as the sheet guide. Accordingly, there is no need of providing a separate shutter in addition to the sheet guide. This leads to reduction of the number of component parts.

What is claimed is:

1. A fixing unit which is detachably attached to an image forming apparatus, and fuses and fixes an unfixed toner onto a recording medium, said fixing unit comprising:

a gripping part which is provided outside said fixing unit and is gripped when said fixing unit is attached to and detached from said image forming apparatus;

a medium introducing port which is provided near said gripping part and to which said recording medium is guided; and a shutter which is provided slanted at a given angle with respect to a gripping surface of said gripping part such that said shutter has a fulcrum at a part thereof closer to said gripping part at said medium introducing port, and is turnable to a position to close said medium introducing port while resisting the urging forces of springs.

2. A fixing unit according to claim 1, wherein said shutter is kept in a state that said shutter opens said medium introducing port by said urging forces of said springs, and said shutter closes said medium introducing port while resisting said urging forces of said springs only when an external force is applied from said gripping part to said shutter.

3. A fixing unit according to claim 2, wherein said medium introducing port is linear in shape, and said shutter is a plate-like member extending in a longitudinal direction of said linear medium introducing port, and said springs are coiled springs provided at both ends of said plate-like shutter as viewed in said longitudinal direction.

4. A fixing unit according to claim 3, wherein said shutter is a transport guide for said recording medium, and said medium introducing port is provided in a bottom of said fixing unit such that a longitudinal direction of said medium introducing port is perpendicular to directions in which said fixing unit is attached to and detached from said image forming apparatus.

5. A fixing unit according to claim 2, wherein said shutter is a transport guide for said recording medium.

6. A fixing unit according to claim 2, wherein said medium introducing port is provided in a bottom of said fixing unit such that a longitudinal direction of said medium introducing port is perpendicular to directions in which said fixing unit is attached to and detached from said image forming apparatus.

7. A fixing unit according to claim 1, wherein said medium introducing port is linear in shape, and said shutter is a plate-like member extending in a longitudinal direction of said linear medium introducing port, and said springs are coiled springs provided at both ends of said plate-like shutter as viewed in said longitudinal direction.

8. A fixing unit according to claim 7, wherein said shutter is a transport guide for said recording medium.

9. A fixing unit according to claim 8, wherein said medium introducing port is provided in a bottom of said fixing unit such that a longitudinal direction of said medium introducing port is perpendicular to directions in which said fixing unit is attached to and detached from said image forming apparatus.

10. A fixing unit according to claim 7, wherein said medium introducing port is provided in a bottom of said fixing unit such that a longitudinal direction of said medium introducing port is perpendicular to directions in which said fixing unit is attached to and detached from said image forming apparatus.

11. A fixing unit according to claim 1, wherein said shutter is a transport guide for said recording medium.

12. A fixing unit according to claim 11, wherein said medium introducing port is provided in a bottom of said fixing unit such that a longitudinal direction of said medium introducing port is perpendicular to directions in which said fixing unit is attached to and detached from said image forming apparatus.

13. A fixing unit according to claim 1, wherein said medium introducing port is provided in a bottom of said fixing unit such that a longitudinal direction of said medium introducing port is perpendicular to directions in which said fixing unit is attached to and detached from said image forming apparatus.

14. A fixing unit according to claim 1, said fixing unit further comprising a heating roller heated by electromagnetic induction.

15. A fixing device comprising a fixing unit which is detachably attached to an image forming apparatus, and fuses and fixes an unfixed toner onto a recording medium, said fixing unit including:

a gripping part which is provided outside said fixing unit and is gripped when said fixing unit is attached to and detached from said image forming apparatus;

a medium introducing port which is provided near said gripping part and to which said recording medium is guided; and a shutter which is provided slanted at a given angle with respect to a gripping surface of said gripping part such that said shutter has a fulcrum at a part thereof closer to said gripping part at said medium introducing port, and is turnable to a position to close said medium introducing port while resisting the urging forces of springs, in which said medium introducing port is provided in a bottom of said fixing unit such that a longitudinal direction of said medium introducing port is perpendicular to directions in which said fixing unit is attached to and detached from said fixing device, wherein in a state that said fixing unit is attached to said fixing device, said shutter is kept in a state that said shutter opens said medium introducing port by said urging forces of said springs, and said recording medium is guided to said medium introducing port, from a lower side of said fixing unit.

16. A fixing device according to claim 15, wherein said fixing unit includes a heating roller heated by electromagnetic induction.

17. An image forming apparatus comprising:

a fixing device which is detachably attached to a main body of an image forming apparatus, and fuses and fixes an unfixed toner onto a recording medium, said fixing device comprising:

a medium introducing port, provided in said fixing device, for introducing said recording medium from said main body of said image forming apparatus to said fixing device; and a recording medium guide for guiding said recording medium to said medium introducing port when said recording medium is introduced from said main body of said image forming apparatus to said fixing device, said recording medium guide being provided on said fixing device and near said medium introducing port, and being turnable to a position to close said medium introducing port when said fixing device is attached to or detached from said image forming apparatus.

18. An image forming apparatus according to claim 17, wherein said recording medium guide includes coiled springs at both ends thereof, and said coiled spring urges said recording medium guide in a direction in which said recording medium guide opens said medium introducing port.

19. An image forming apparatus according to claim 18, wherein said recording medium guide is held with said coiled springs at a position where said recording medium guide opens said medium introducing port, and said recording medium guide is turned, while resisting the urging forces of said coiled springs, when said recording medium guide is turned to a position to close said medium introducing port.

20. An image forming apparatus according to claim 19, wherein said fixing device includes stoppers which come in contact with both ends of said recording medium guide at a position where said recording medium guide closes said medium introducing port.

21. An image forming apparatus according to claim 18, wherein said fixing device includes stoppers which come in contact with both ends of said recording medium guide at a position where said recording medium guide closes said medium introducing port.

22. An image forming apparatus according to claim 17, wherein said fixing device includes stoppers which come in contact with both ends of said recording medium guide at a position where said recording medium guide closes said medium introducing port.

23. An image forming apparatus according to claim 17, wherein said fixing device includes a heating roller heated by electromagnetic induction.

* * * * *